United States Patent [19]

McNeeley

[11] Patent Number: 4,882,958

[45] Date of Patent: Nov. 28, 1989

[54] STACKING SOCKET WRENCH SET

[76] Inventor: Richard L. McNeeley, 3088 W. 5825 South, Roy, Utah 84067

[21] Appl. No.: 283,077

[22] Filed: Dec. 5, 1988

[51] Int. Cl.[4] ..... B25B 13/06

[52] U.S. Cl. ..... 81/124.4; 81/177.2; 81/439

[58] Field of Search ..... 81/121.1, 124.3, 124.4, 81/124.6, 177.2, 185, 439, 461

[56] References Cited

U.S. PATENT DOCUMENTS

| | | | |
|---|---|---|---|
| 2,991,678 | 7/1961 | Adolphson | 81/124.4 X |
| 3,532,012 | 10/1970 | Pryor | 81/124.3 X |
| 4,620,460 | 11/1986 | Gonzales, Jr. | 81/124.4 |

*Primary Examiner*—James G. Smith

*Attorney, Agent, or Firm*—A. Ray Osburn

[57] ABSTRACT

A socket wrench set including multiple socket heads for a range of nut and bolt sizes, which fit together in any desired order to serve as a wrench extension. Each socket head has a passage therethrough to provide clearance for the threaded stems of bolts extending considerable distance through the associated nuts.

9 Claims, 2 Drawing Sheets

STACKING SOCKET WRENCH SET

BACKGROUND OF THE INVENTION

1. Field: The field of the invention is manual tools, particularly socket wrenches wherein differently sized heads are designed to interfit together.

2. State of the Art: Typically, socket wrench sets include a number of socket heads sized for a range of nuts and bolt heads. The socket heads are used interchangeably with a single wrench handle. Such socket sets are difficult to store and transport between use sites, a specially designed case typically being necessary. When the nut or bolt head is in a recessed location, the socket must be engaged by an extension drive bar in turn engaged by the handle at its opposite end. U.S. Pat. No. 1,371,350 discloses a socket set which further utilizes such a drive bar as a carrier for the wrench set between uses. The individual sockets do not, however, engage together for use U.S. Pat. No. 851,068 discloses a set of socket heads which to a limited extent can be used while assembled together. The sockets in this set assemble in order of increasing size from a drive handle. To use one of the smaller sockets, all of the larger sockets must be removed from the set. More recently, U.S. Pat. No. 4,620,460 also discloses a set of socket heads designed to fit together to be used as an extension. The socket heads cannot be assembled in random order, but only in order of decreasing size from the handle. Each socket of the desired size may be removed from the stack and secured at the end to the smallest socket in the set. This set is inconvenient to use as an extension substitute, because the general order of the sockets must always be preserved, and the particular smallest socket always used. Another problem not solved by the prior art is the removal of nuts through which the bolts extend a substantial distance. The interior cavities of state of the art socket heads are too shallow to engage such nuts, except in specialized, long shank spark plug tools or the like. Thus, prior art socket head sets fail to provide the versatility and adaptability needed to accomplish frequently required tasks with a minimum of inconvenience.

BRIEF SUMMARY OF THE INVENTION

With the foregoing in mind, the present invention eliminates or substantially alleviates the shortcomings in prior art socket wrench sets, by providing such a set wherein the socket heads may be stacked together in random order to be used as an extension, and wherein each socket head has a bolt stem clearing passage therethrough. Provisions are made for transfer of torque through the stacked set of socket heads. Since the socket heads may be assembled in any desired order, full extension length may be utilized for use with nuts and bolt heads in recessed locations, regardless of their size.

It is therefore the principal object of the invention to provide a stacking socket wrench set of greatly increased utility, versatility and convenience over present sets.

BRIEF DESCRIPTION OF THE DRAWINGS

In the drawings, which represent the best mode presently comtemplated for carrying out the invention.

DETAILED DESCRIPTION OF ILLUSTRATED EMBODIMENTS

Figure 1:
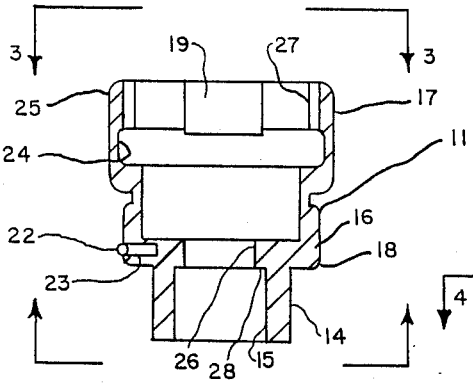
FIG. 1 is a vertical sectional view of one of the individual sockets of the drawn to substantially full scale.
Figure 2:
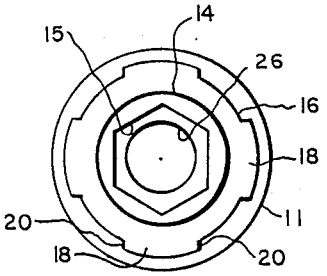
FIG. 2 is a bottom view of the socket of FIG. 1, taken along line 2—2 thereof drawn the same scale, FIG. view of the socket of FIG. 1, taken along line 3—3 there drawn to the same scale, FIG. 4 a top plan view of the handle adaptor member of the invention, take along line 4—4 of FIG. 5, drawn to the scale of FIG. 1, FIG. 5 a vertical sectional view of the socket wrench set of the invention showing the individual sockets thereof secured together end to end in descending order of size from FIG. 6 a vertical elevational view of the socket wrench set of the invention, partially cut away, showing the individual sockets thereof assembled in another order, drawn to the scale of FIG. 5, and FIG. 7 a longitudinal cross sectional view of the socket wrench set of the invention, incorporating however a reduced number of sockets, shown in use upon a nut through which the corresponding bolt extends several diameters along the central cavity of the assembled wrench set, drawn to the scale of FIG. 5.
Figure 3:
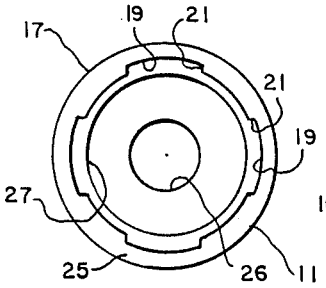
Figure 4:
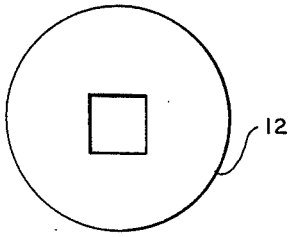
Figure 5:
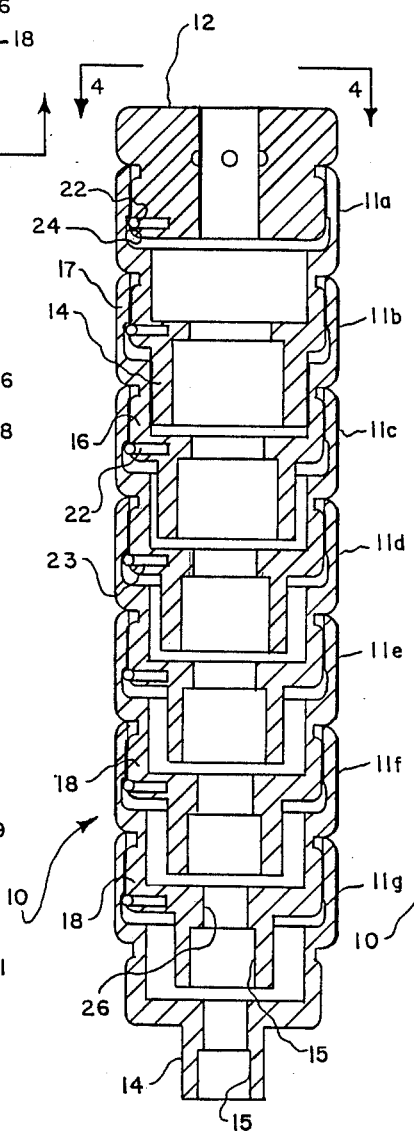
Figure 6:
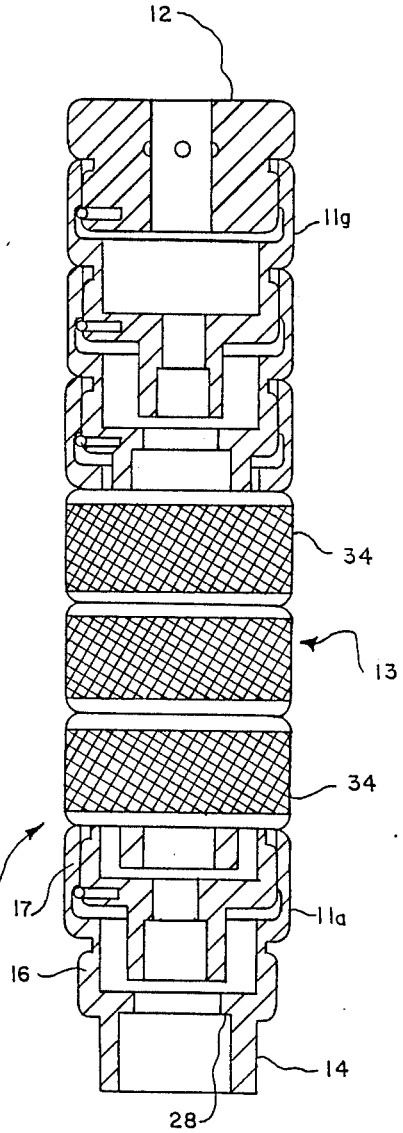

Socket wrench set 10 comprises a plurality of individual socket heads 11, each designed to wrench a particular nut or bolt head within a range of sizes. The illustrated embodiment comprises seven such sockets, numbered 11*a* through 11*g*, as shown in FIG. 5 stacked joined together in order of decreasing size from a handle adapter head 12. The sockets 11, or any two or more thereof, may be joined in any desired order, since they are completely interchangeable within the stack 13. In FIGS. 5 and 6, for example, the stack 13 is arranged with the smallest socket ll*g* respectively at the bottom and at the top of the stack 13. Socket 11*g* is in nut-engaging position in FIG. 5, while socket ll*a* is so positioned in FIG. 6. Both of the stacks 13 utilize all of the sockets 11. As indicated above, stacks 13 incorporating any desired number of sockets may be employed.

To achieve the complete interchangeability of sockets 11, all are constructed of identical dimensions, with the exception of the working ends 14, which of course must vary in size to accommodate the range of nut and bolt head sizes. The lowermost working ends 14 of each illustrated socket 11 has a hexagonal nut-engaging cavity 15, an intermediately located male connector 16 and an uppermost, female, connector 17. Each male connector 16 joins with the female connector 17 of the next lower socket 11, while its female connector 17 joins with the male connector 16 of the immediately higher socket 11. Since connector portions 16 and 17 are of identical lengths and diameters in all of the sockets 11, all sockets of the set may be assembled together in any desired order. The removal of one or more sockets 11 from the set in no way prevents assembly, in any desired order, of those remaining. As previously stated, any two or more of the sockets 11 may be assembled together for use as desired. Each socket 11 may be joined to handle head 12, further insuring the random order capability. (FIGS. 1–6).

To prevent rotation of the sockets 11 relative to each other, equally spaced torque keys 18 and matching keyways 19 are provided on male connector 16 and within female connector 17. Projections 18 and keyways 19 engage by contact of end surfaces 20 and 21, to transmit torque through the stack 13, when it is used as an extension for manipulating recessed bolt heads and nuts. The full stacked length of all the sockets 11 may be utilized regardless of the size of the bolt or nut to be manipulated. A detent assembly 22, carried in a radially directed blind bore 23 in each male connector 16, and in handle head 12, snaps into a circumferential groove 24 in the wall 25 of female connector 17, to hold sockets 11 together until forcibly separated.

Figure 7:
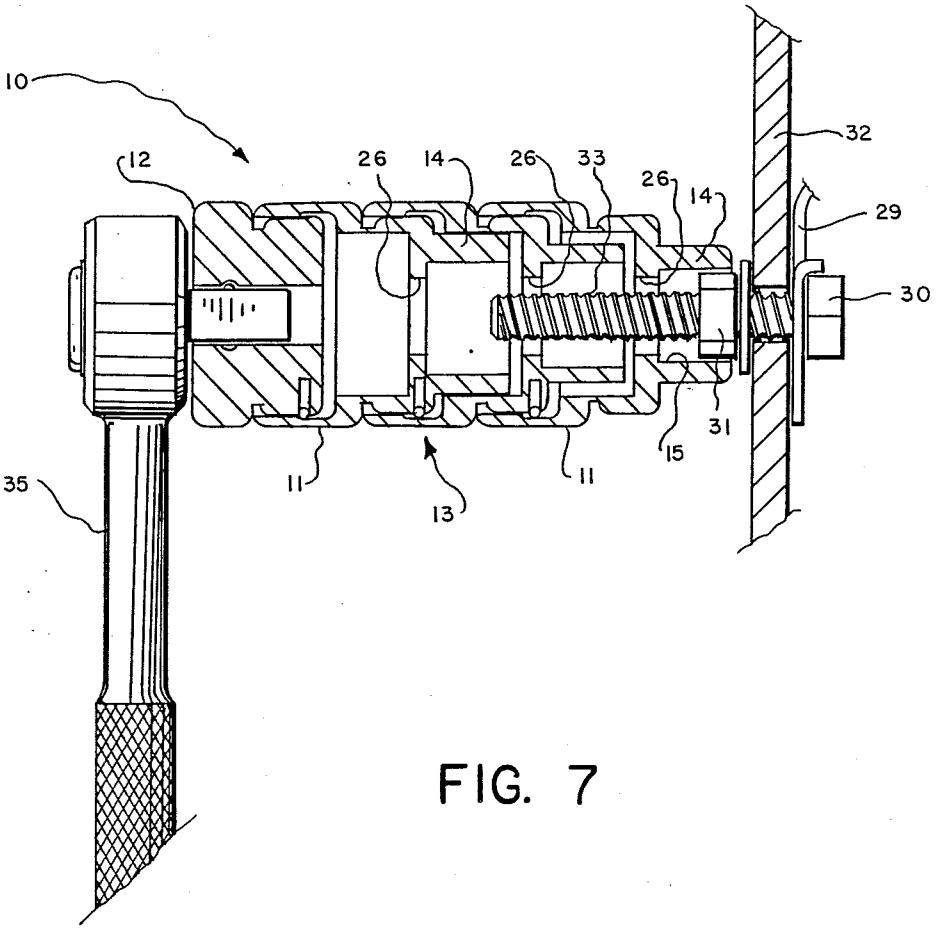

Each of the socket heads 11*a* through 11*g* carries a bore 26 communicating between the hexagonal cavity 15 and cavity 27 in male connector 16. The bores 26 each provide a shoulder 28 to function as a stop for the nuts or bolt heads. Bore 26 of each socket 11 is also of sufficient diameter to clear the threaded stem of the associated bolt. This arrangement enables socket set 10 to, unlike typical sets, be used even though a bolt extends a great distance through its nut. See FIG. 7, for example, showing a thin brace 29 secured by a bolt 30 and a nut 31 to a bulkhead 32. The aligned bores 26 of abbreviate stack 13 provides the necessary clearance for bolt stem 33, to permit socket 11*c* to engage nut 30.

Socket set 10 may incorporate additional features or be changed in detail. For example, knurls 34 may be provided to facilitate use of stack 13 without handle assembly 35. Fewer or greater numbers of sockets 11 may be incorporated into the set. The hexagonal cavities 15 may be changed to square or pentagonal if needed for particular uses. Other means than those illustrated could be devised to prevent the rotation of the individual sockets with respect to each other within the set. For example, aligned radial bores could be employed with pins or the like, to both prevent relative rotation and to secure the tacked sockets together.

The invention may be embodied in other specific forms without departing from the spirit or essential characteristics thereof. The present embodiments are therefore to be considered as illustrative and not restrictive, the scope of the invention being indicated by the appended claims rather than by the foregoing description, and all changes that come within the meaning and range of equivalency of the claims are therefore intended to be embraced therein.

What is claimed and desired to be secured by U.S. Letters Patent is:

1. A socket wrench set comprising:

a plurality of individual sockets each having a working end with a cavity sized and shaped to fit one of a series of bolt heads and nuts of various sizes; wherein said sockets include means permitting the assembly of any number thereof together end to end in any desired order, irrotationally with respect to each other, without regard to the relative positions of the individual sockets within the stack, to form a torque transmitting stack of said sockets.

2. The socket wrench set of claim 1, wherein each socket further comprises:

an open ended bore aligned with and joined to the working end cavity, said bore being at least of sufficient size to clear the stems of the bolts used with nuts sized to be fitted by the working end cavity.

3. A socket wrench set including a plurality of monolithic sockets each adapted for use with one of a series of variously sized nuts and bolt heads, each socket comprising:

a working portion at one end thereof, with a cavity sized and shaped to fit one of said nuts and bolt heads;

an intermediate male connector portion having a cavity sized and shaped to accept therein any one of the working end portions of the remaining sockets in the set; having a cavity sized and shaped to accept therein the male connector portion of any one of the remaining sockets in the set; wherein the male and female portions are identically shaped and sized in all sockets of the set; so that any socket of the set may be assembled with any other by simultaneous insertion of its working portion and its male portion into the male connector cavity and the female connector of the other socket respectively; and wherein the set further comprises provisions for preventing rotation of the sockets with respect to each other when two or more are so assembled together.

4. The socket wrench set of claim 3, wherein each socket further comprises:

an open ended bore aligned with and joined to the working cavity, said bore being at least of sufficient size to clear the stems of the bolts used with nuts sized to be fitted by the working cavity.

5. The socket wrench set of claim 3, wherein the rotation preventing provisions comprise:

at least one key carried by the male connector portion extending outwardly therefrom; and an inwardly facing matching keyway carried by the female connector portion.

6. The socket wrench set of claim 4, wherein the rotation preventing provisions comprise:

at least on key carried by the male connector portion extending outwardly therefrom; and an inwardly facing matching keyway carried by the female connector portion.

7. The socket wrench set of claim 6, further comprising:

provisions securing the assembled socket held together.

8. The socket wrench set of claim 7, wherein the socket securing provisions comprise:

a spring-loaded detent assembly installed within an outwardly opening bore in the male connector portion of each socket; and an inwardly opening circumferent the female connector portion positioned to be engaged by the detent when the socket are assembled together.

9. The socket wrench set of claim 8 , further comprising:

a handle adapter member sized and shaped for insertion into the female connector portion and including provisions preventing its rotation with respect thereto.

* * * * *